US005091752A

United States Patent [19]

Okada

[11] Patent Number: 5,091,752

[45] Date of Patent: Feb. 25, 1992

[54] IMAGE HEATING APPARATUS USING FILM DRIVEN BY ROTATABLE MEMBER

[75] Inventor: Tamotsu Okada, Kawasaki, Japan

[73] Assignee: Canon Kabushiki Kaisha, Tokyo, Japan

[21] Appl. No.: 658,299

[22] Filed: Feb. 20, 1991

[30] Foreign Application Priority Data

| | | | |
|---|---|---|---|
| Feb. 20, 1990 | [JP] | Japan | 2-39025 |
| Feb. 20, 1990 | [JP] | Japan | 2-39026 |
| Feb. 20, 1990 | [JP] | Japan | 2-39027 |
| Feb. 20, 1990 | [JP] | Japan | 2-39028 |

[51] Int. Cl.[5] ..... G03G 15/20

[52] U.S. Cl. ..... 355/285; 355/289; 355/290

[58] Field of Search ..... 355/282, 285, 289, 290, 355/284, 295, 283; 219/216, 469, 470; 430/60

[56] References Cited

U.S. PATENT DOCUMENTS

| | | | |
|---|---|---|---|
| 3,578,797 | 5/1971 | Hodges et al. | 263/3 |
| 4,095,886 | 6/1978 | Koeleman et al. | 219/216 X |
| 4,364,661 | 12/1982 | Landa | 355/274 |
| 4,568,275 | 2/1986 | Sakurai | 219/216 X |
| 4,949,096 | 8/1990 | Ogawa et al. | 346/25 |
| 4,954,845 | 9/1990 | Yano et al. | 355/290 |
| 4,973,824 | 11/1990 | Ohashi et al. | 355/290 X |
| 5,026,276 | 6/1991 | Hirabayashi et al. | 432/59 |
| 5,043,763 | 8/1991 | Koh et al. | 355/206 |

*Primary Examiner*—A. T. Grimley
*Assistant Examiner*—Thu Dang
*Attorney, Agent, or Firm*—Fitzpatrick, Cella, Harper & Scinto

[57] ABSTRACT

An image heating apparatus includes a heater; a film movable in contact with a recording material carrying an image, wherein the image on the recording material is heated by heat from the heater through the film; a driving rotatable member for driving the film; wherein the driving rotatable member has a heat insulative surface layer.

27 Claims, 7 Drawing Sheets

IMAGE HEATING APPARATUS USING FILM DRIVEN BY ROTATABLE MEMBER

FIELD OF THE INVENTION AND RELATED ART

The present invention relates to an image heating apparatus using a film driven by a rotatable member, for fixing an image or improving the surface property thereof by heating the image on a recording material.

A widely used type of a heat-fixing apparatus usable with an image forming apparatus, comprises a heating roller maintained at a predetermined temperature and back-up roller or a pressing roller press-contacted to the heating roller, the pressing roller having an elastic layer The recording material carrying an unfixed toner image is passed through a nip formed between the heating roller and the pressing roller, by which the image thereon is heated and fixed. However, in such a heat roller type image fixing system, the temperature of the heating roller is required to be correctly controlled at a proper level in order to prevent the toner off-set to the heating roller. In order to reduce the temperature variation of the heating roller, the thermal capacity of the heating roller is required to be large, with the result of the longer time until the temperature of the heating roller reaches the predetermined level, the longer waiting period, and a large electric power consumption.

U.S. Pat. No. 3,578,797 proposes a heat-fixing apparatus using an endless belt, in which the recording material is separated from the endless belt after the toner image cooled and solidified, thus reducing the toner off-set.

U.S. Ser. Nos. 206,767, 387,970, 409,341, 416,539, 426,082, 435,247, 430,437, 440,380, 440,678, 444,802 and 446,449 which have been assigned to the assignee of this application propose that using a heater which can be instaneously raised in the temperature thereof and a thin film, the toner image is heated and fixed by the heater through the film, so that the warming-up period is significantly reduced. In this system, the heater is stationary, and the film is driven by a driving roller.

In order to prevent deformation of the driving roller, it is made of a rigid material such as metal, with the result that it has a large thermal capacity. Therefore, the heat from the heater is conducted through the film to the driving roller, and therefore, the thermal efficiency decreases.

Since the recording material generally contains water, it produces vapor upon being heated by the heater. Since the driving roller is cold, the vapor is condensed to form dew on the driving roller or on the fixing film contacted to the driving roller. The dew droplets may disturb the unfixed toner image if it drops thereon.

If the driving roller is made of elastic material, which generally has a large thermal expansion coefficient, the diameter of the driving roller changes significantly during the temperature raising period, with the result of non-constant speed of the fixing film, that is, the non-constant recording material feeding speed.

Since the film has a small thickness, the film may slip or is creased, depending on the frictional force between the driving roller and the film.

SUMMARY OF THE INVENTION

Accordingly, it is a principal object of the present invention to provide a heating apparatus wherein the reduction of the thermal efficiency due to the driving roller is minimized.

It is another object of the present invention to provide a heating apparatus wherein the slippage or damage of the film is prevented.

It is a further object of the present invention to provide a heating apparatus having a driving roller provided with a surface insulating layer.

It is a further object of the present invention to provide a heating apparatus wherein the friction coefficient between the driving roller and the film is larger than that between the follower roller and the film.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
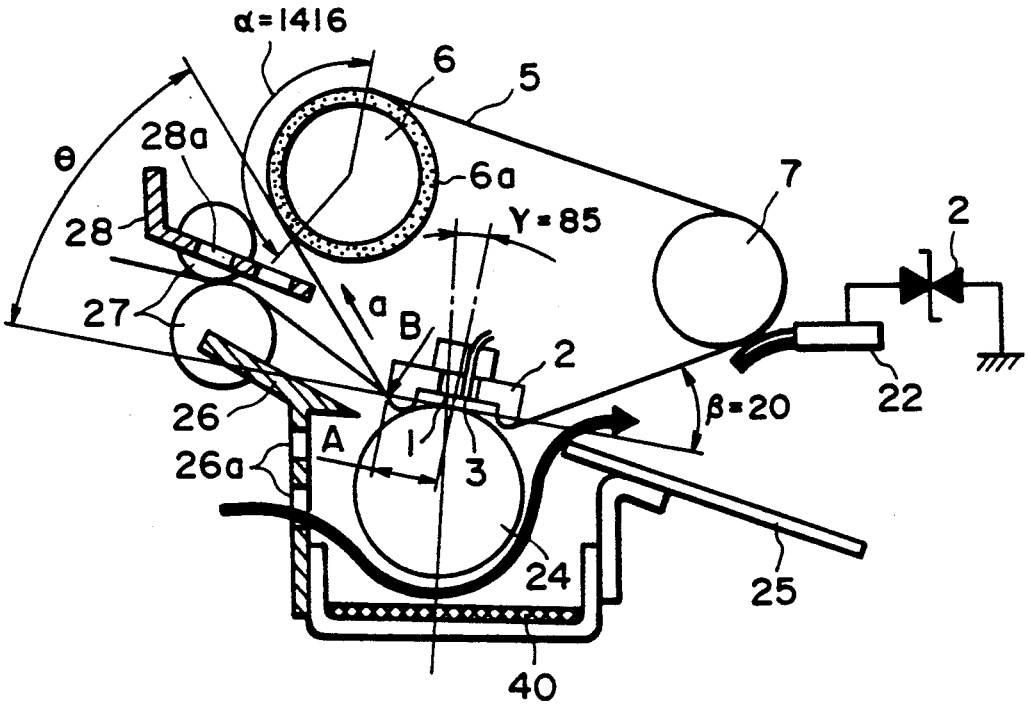
FIG. 1 is a sectional side view of a heating apparatus according to an embodiment of the present invention.

Referring to FIG. 1, there is shown a heat-fixing apparatus according to an embodiment of the present invention. It comprises a low thermal capacity heater 1 having an alumina base plate having a good thermal conductivity and having a thickness of 1 mm and a width of 7 mm, a heat generating resistor layer and a glass layer for protecting the heat generating resistor layer. The heater 1 is fixed on a supporting member 2 by a heat resistive maleimide bonding agent, the supporting member 2 being fixed on a stay of the fixing apparatus and being made of heat resistive and heat-insulative resin such as liquid crystal polymer or PPS resin. On the backside of the heater 1, a temperature detecting element 3 is fixed by a silicone bonding agent. The temperature detecting element 3 is disposed within a range in which a minimum size sheet (business card size in this embodiment) usable with the apparatus. At the opposite ends of the heater 1, there are exposed electrode layers (Ag layers).

Figure 2:
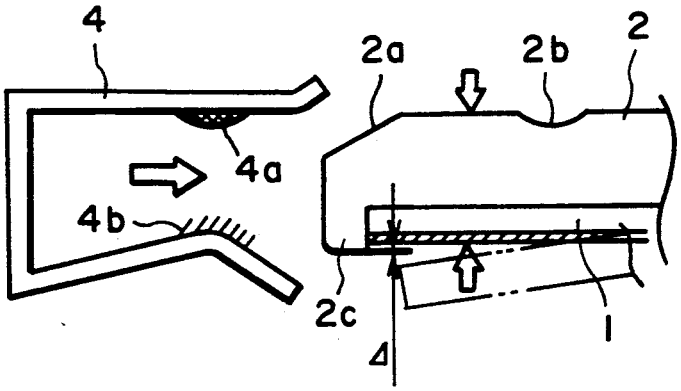
FIG. 2 is an enlarged detailed side view of contacts between a heater and a supporting member in the heating apparatus of FIG. 1.

As shown in FIG. 2, a contact member 4 is provided with a confining projection 4*a* and a resilient contact 4*b*. At an end of the supporting member 2 is formed a guiding slant 2*a* for facilitating insertion. Also provided is a contact confining recess 2*b* engageable with the projection 4*a*. The contact member 4 grips the supporting member 2 and the heater 1 with a predetermined contact pressure. With this structure, the end of the heater 1 is prevented from peeling off. During the heating period, the contact is not influenced by the thrust displacement attributable to the thermal expansion of the supporting member 2 and the heater 1 In addition, it is prevented from being released from the contact member, so that the electric power supply to the heater is stabilized. There is a rib 2*c* at an end of the supporting member 2 to function as a thrust stopper for the heater 1. The rib 2*c* is projected 0.3–1 mm beyond the bottom surface of the heater 1. Since the base plate is made of alumina, the edge thereof is sharp due to the machinability thereof, and therefore, the contact 4*b* is liable to be damaged upon insertion of the contacts. The above-described projection of the rib 2*c* is effective to prevent the damage by providing suitable guide.

Designated by a reference numeral 5 is an image fixing film comprising a base layer of polyimide resin and having a thickness less than 25 microns and a parting layer of fluorinated resin treated to have a low resistance by conductive carbon powder, wherein the base layer is coated with the parting layer, and the total thickness is less than 35 microns. The film 5 is in the form of an endless belt having a diameter of 45 mm. It is driven in a direction a by a driving roller 6 disposed downstream the nip at a peripheral speed of 47 mm/sec. The driving roller 6 has a diameter of 18.4 mm, and is coated with 75 microns of electrically conductive silicone rubber layer.

By adding the conductive material in the silicone rubber, the surface of the driving roller acquires low resistance, by which the possible reduction of the frictional coefficient between the driving roller and the film due to foreign matter such as paper dust or the like due to the charging-up of the driving roller surface, is prevented.

Upstream the nip, a metal tension roller 7 is supported to be rotated following the rotation of the fixing film 5. The tension roller 7 functions to stretch the fixing film 5 with the aid of the spring member not shown with the total tension force of 3 kg.

In this embodiment, the frictional coefficient $\mu$ of the driving roller 6 relative to the fixing film 5 is made larger than the frictional coefficient between the tension roller 7 and the fixing film. By doing so, the damage such as crease or the like of film can be prevented. Such a damage may be caused by shifting forces produced in different directions to the film.

In addition, the frictional coefficient between the driving roller and the film is larger than that between the heater and the film. By making the frictional coefficient between the driving roller and the film maximum, the film drive is further stabilized.

Similarly, the outer diameter of the driving roller 6 is made larger, and the center of the driving roller 6 is disposed at a higher level than the center of the tension roller 7, by which the angular range of the driving roller 6 in which the fixing film 5 is wrapped therearound is made larger to stabilize the film drive. In this embodiment, the metal tension roller 7 has an outer diameter of 14 mm, and the angular region $\alpha$ of the driving roller in which the fixing film 54 is wrapped is 141.6 degrees. The contact surfaces of the film 5 and the heater 1 therebetween are supplied with a small quantity of heat-resistive fluorinated grease for the purpose of lubrication (160±25 mg, in this embodiment). This is effective to prevent vibration, sticking and torque increase thereby of the fixing film 5 moved in sliding compress-contact with the surface of the fixed heater 1.

It is desirable that the frictional coefficient $\mu$ between the driving roller and the film is within the range of $0.3<\mu<3$. If it is not more than 0.3, the film may slip when the load of the film is increased. If, on the contrary, the frictional coefficient is not less than 3, the lateral position of the film relative to the driving roller does not change even if the lateral shifting force to the film becomes large, and therefore, the film may be folded back or creased. The above-described range is effective when the grease is not applied.

In addition, the image fixing apparatus of this embodiment is provided with a lateral shift control system for the fixing film 5.

Figure 3:
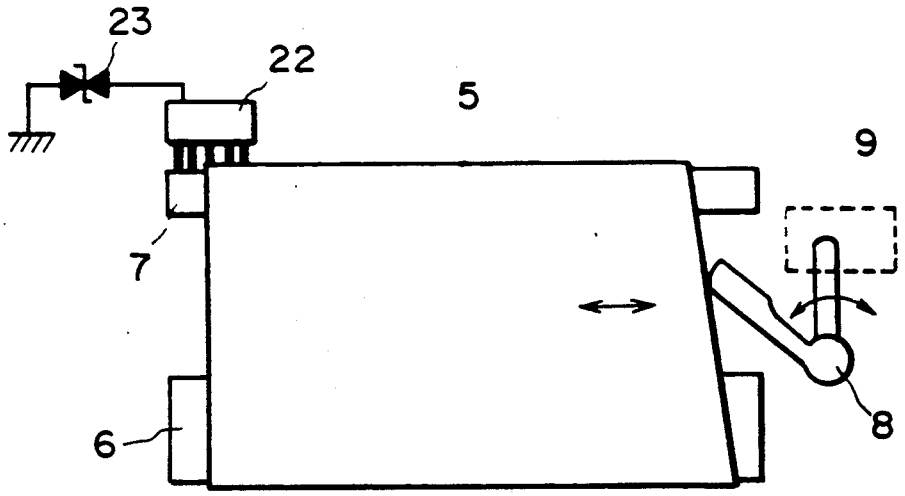
FIG. 3 is an enlarged top plan view of a lateral shift control means for the heating or fixing film.

As shown in FIG. 3, a detection lever 8 for detecting the position of the film 5 is provided adjacent a lateral end of the fixing film 5 so as to follow the lateral displacement of the film. The position of the film 5 is read by a non-contact type sensor 9. The lateral end of the fixing film is inclinedly cut, so that the sensor 9 for the detecting lever 8 is intermittently rendered on and off. On the basis of the time period in which the sensor 9 is on or off, the direction of the lateral shift, and the controlling region are discriminated.

Figure 4:
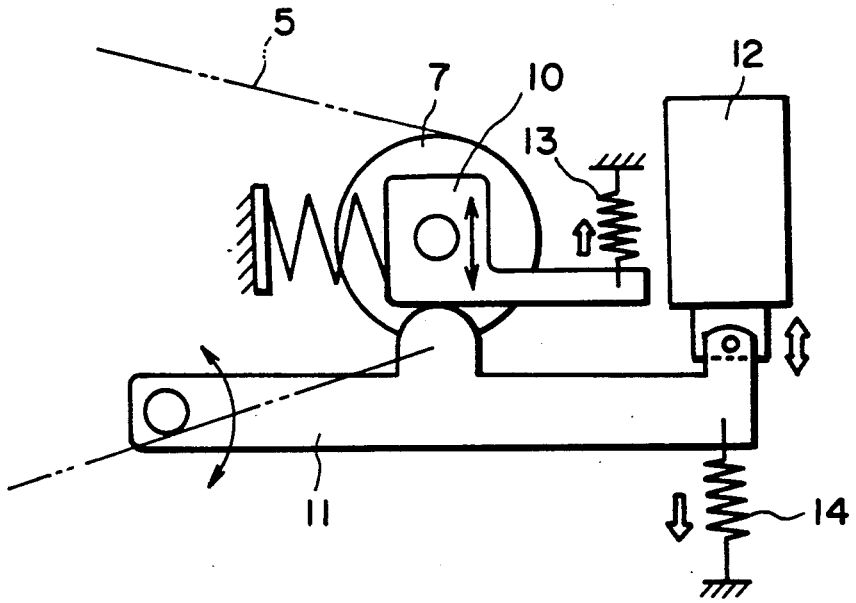
FIG. 4 is a side view of the control means shown in FIG. 3.

The switching of the lateral shifting direction is accomplished by a bearing 10 for the tension roller 7, as shown in FIG. 4. The bearing 10 is substantially vertically displaceable by a swingable control arm 11. A latching solenoid 12 is associated with the controlling arm 11, and when the sensor 9 produces a reversing signal, the latching solenoid 12 operates to vertically move the control arm 11 to displace the tension roller. The bearing 10 is provided with a first spring 13 for upwardly urging the bearing 10 and with a second spring 14 for downwardly urging it. When the bearing 10 takes its upper position, the urging force by the first spring 13 is zero, and the downward urging force by the second spring 14 is maximum. When the bearing 10 takes the lower position, the upward urging force by the first spring 13 is maximum, and the urging force by the second spring 14 is zero. By doing so, the urging force by the spring is effectively used during the upward and downward movement, in connection with the attraction force by the latching solenoid 12. This permits a longer stroke of the latching solenoid 12, and therefore, a compact solenoid and the vertical movement with small electric current. As regards the deliberate lateral shifting directions, when the tension roller 7 takes the upper position, the film shifts to the upper side, and if the tension roller takes the lower position, the film shifts in the opposite direction By permitting the lateral movement of the fixing film 5 in a predetermined range, the lateral shifting of the fixing film 5 is stably controlled.

The lateral shift control of this type is used because (1) the fixing film 5 which is so thin may be damaged or torn if the conventional stopper flange or perforations are used, and because (2) the heat resistive film such as polyimide film or the like used for the film base plate is hardly elastic, and the lateral shift stabilization by a tapered roller or crowned roller is not possible.

The switching of the deliberate lateral shifting is effected by a tension roller 7 upstream of the nip, because otherwise, the separating station where the recording material is separated from the film is influenced. Therefore, it can be accomplished by a roller upstream of the nip or another additional member.

In this embodiment, an upper unit is constituted by the low thermal capacity heater 1, a supporting member 2, a temperature detecting element 3, an image fixing film 5, a driving roller 6, a tension roller 7, a lateral shift controlling mechanism (bearing 10, a control arm 11, a latching solenoid 12) and a film position detecting means (detecting lever 8).

Figure 5:
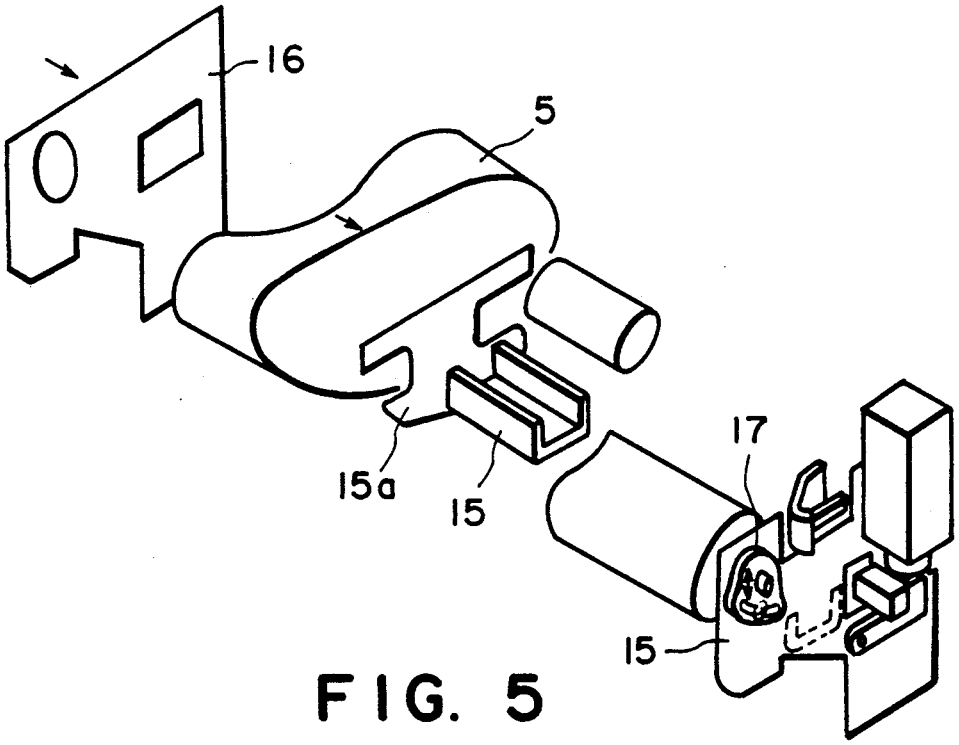
FIG. 5 is an enlarged perspective view of a fixing film unit of the heating apparatus of FIG. 1.

They are mounted on a basic member, that is, a head stay 15, as shown in FIG. 5. One 15*a* of the side plates has an area smaller than a cross-sectional area of the fixing film 5 to permit mounting of the film. After the film is mounted, it is constituted as an integral upper unit by a subordinate side plate 16 for mounting the rollers or the like. The upper unit alone is sufficient to effect the lateral shift control and the adjustment for the stabilization of the lateral shift control. Therefore, the fixing film can be exchanged, or the pressing member can be exchanged, or the upper unit may be maintained independently in an office or outside the plant. It is also possible to replaced only the upper unit, rather than the entire fixing apparatus, thus improving the servicing operation. The lateral shift control is adjusted by changing the relative position of the driving roller 6 in consideration of the variations in the cylindricity of the fixing film 5 and the position of the heater 1 or the like, while rotating the eccentric bearing 17 of the driving roller 6. In this embodiment, the eccentricity is ±0.6 mm in the vertical direction. The eccentricity may be provided in the horizontal direction. However, the horizontal eccentricity is compensated for by the tension of the fixing film 5, and therefore, the influence to the lateral shifting is large if the eccentricity is vertical, and therefore, the degree of eccentricity can be made smaller. Therefore, the vertical eccentricity is preferable. The vertical stroke of the tension roller 7 is 3 mm, but it may be larger depending on the types of the vertical moving means so as to compensate for the variations in the other parts. In addition, the lateral shift control may be stabilized by adjusting the vertical stroke itself. However, when the position of the tension roller 7 is at the same level or at a lower level than the level of the point where the recording material enters, it may be contacted by the uncontrollable motion of the recording material or the curling of the recording material, upon the recording material entering. If this occurs, the unfixed toner image is disturbed. In view of the above, the position of the tension roller 7, that is, the nip entering angle of the fixing film 5 ($\beta$ in FIG. 1) is preferably approximately 10–30 degrees from the horizontal plane. In this embodiment, it is 20 degrees.

The upper unit described in the foregoing is combined with a lower unit having a pressing member, pressing means and recording material guide or the like to constitute an image fixing apparatus.

Figure 6:
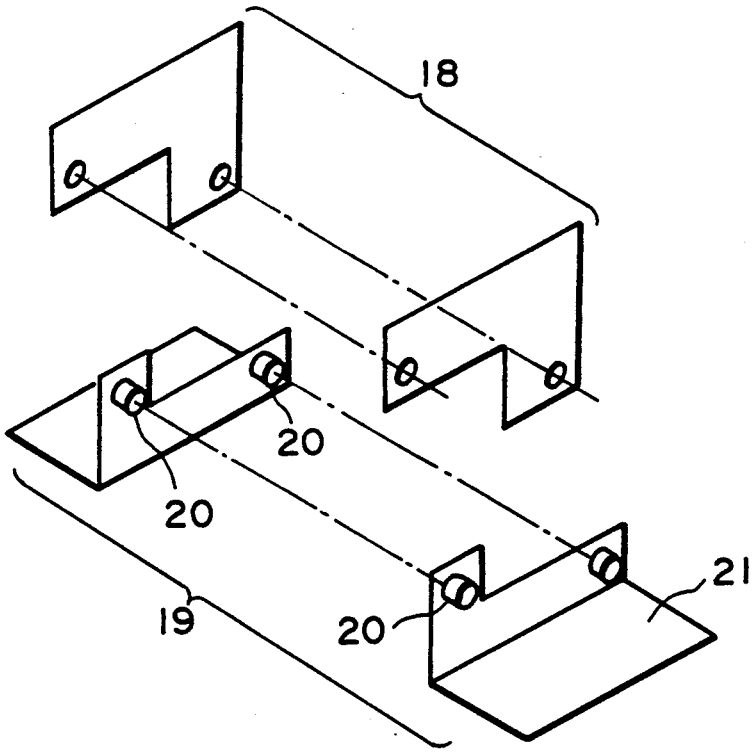
FIG. 6 is a perspective view illustrating the way of putting the unit of FIG. 5 and a lower unit together.

As shown in FIG. 6, the upper unit 18 and the lower unit 19 are provided with engaging holes and pins. After engagement between the associated pins and holes, they are fixed by securing means such as screws or the like. At this time, at least one of the four engaging pins 20 of the lower unit 19 is an eccentric pin 21 to permit adjustment the level difference and twist angle between the front side and the rear side, thus reducing the twist of the upper unit 18 during the combination thereof with the lower unit, by which the adverse affect to the lateral shift control is minimized.

As for the measure against the electric charging of the fixing film 5, electric discharging means 22 made of brush or the like is used in contact both with the surface layer of the film and the tension roller 7. The discharging means 22 comprises a constant voltage element grounded through a varister 23.

The silicone rubber of the driving roller surface is electrically conductive, and therefore, the contact thereof with the electrically conductive parting layer of the film at an end of the film establishes grounding of the driving roller through the varister, so that the prevention of the charging-up of the driving roller is further enhanced.

Maintaining the film surface at a predetermined electric potential is effective to prevent the electrostatic off-set.

The rubber 6*a* of the surface layer of the driving roller 6 has a heat insulating function to prevent rapid temperature decrease of the fixing film 5 and to preventing the dew on the driving roller 6 or the fixing film 5 adjacent the roller. If, however, the silicone rubber 6*a* has a too large thickness, the expansion of the rubber 6*a* upon the temperature increase of the roller becomes large, with the result of a significant change of the diameter of the driving roller 6, that is, the peripheral speed change of the fixing film 5. In consideration of the balance between the heat insulating effects and the diameter change, the thickness of the silicone rubber layer 6*a*, that is, the thickness of the rubber layer is preferably 20 microns–1.5 mm.

Referring back to FIG. 1, the pressing member 24 in the lower unit 19 is press-contacted to the heater 1 through the fixing film 5 from the bottom. The toner image on the recording material is passed through the nip formed between the pressing member 24 and the fixing film 5, and is heat-fixed on the recording material. The pressing member 24 is in the form of a roller having an elastic layer, and the surface layer thereof is coated with fluorinated resin material, and therefore, is prevented from contamination with the toner by the enhanced parting property. The outer diameter thereof is 20 mm, and the hardness thereof is approximately 40 degrees. The recording material is guided by the inlet guide 25 into the nip and is prevented from being wrapped around the pressing member 24 by a separation guide 26 guiding it outwardly. In the fixing system, as described hereinbefore, the heater 1 has a low thermal capacity, and therefore, it is heated up very quickly to the operating temperature. Correspondingly, however, the temperature of the pressing member 24 at the initial stage is still low in the temperature with the result of a larger temperature difference between a front side and a backside of the recording material. This has a tendency of increasing the degree of the curling. In this embodiment, the bottom curling is large, and therefore, a pair of discharging rollers 27 is disposed at a level higher than that of the recording material separating point for the purpose of reducing the curling.

A sheet discharging cover 28 is fixed on the fixing apparatus and is not openable. The reason is that if the cover is opened, a significant part of the film is exposed and is therefore may be damaged by the user or by dropping something thereon. If this occurs, the pressing member 24 may be damaged. As a preventive measure, the sheet discharging structure is fixed.

The description will be made as to the release of the pressing member 24. The apparatus of this embodiment is provided with a pressure releasing mechanism in order to permit clearance of the jammed sheet while protecting the film, upon occurrence of the sheet jam.

Figure 7A:
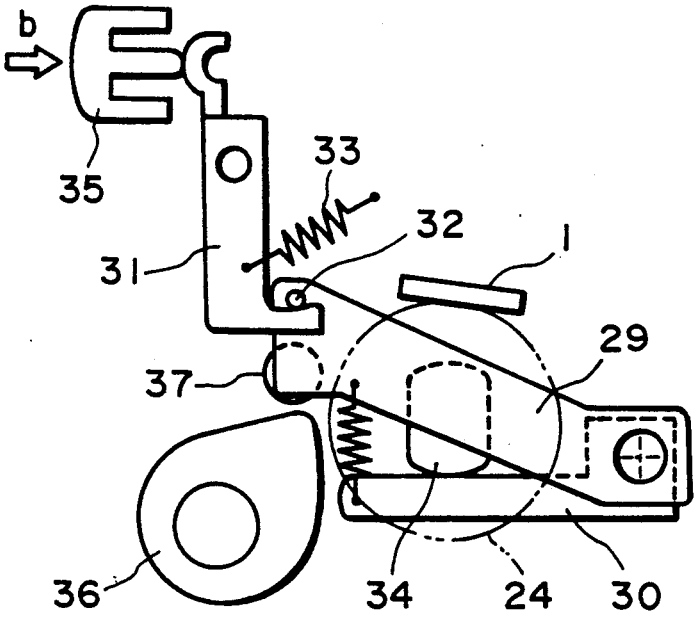
FIGS. 7A and 7B are enlarged side views of a pressure releasing mechanism used in the heating apparatus of FIG. 1.
Figure 7B:
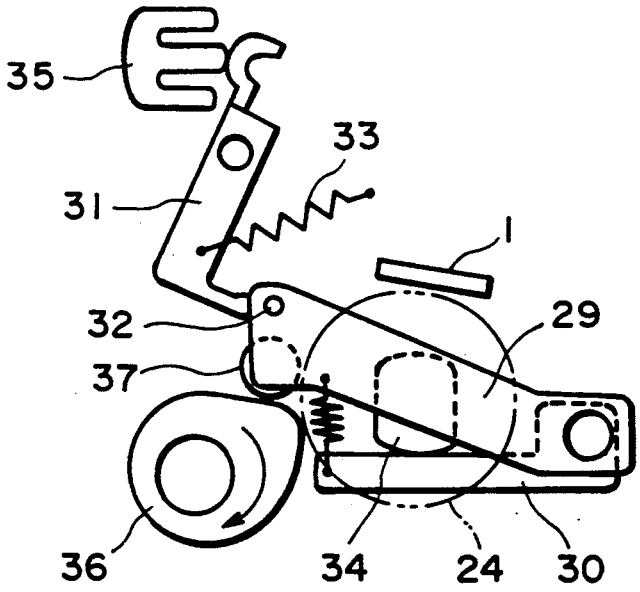

FIG. 7A shows the state wherein the pressing member 24 is in the pressing state, and FIG. 7B shows the state in which the pressure is released. An upper pressing lever 29 and a lower pressing lever 30 are rotatably supported on a common shaft. The levers 29 and 30 are pressed by pressing springs not shown. The respective pairs of front and rear springs are provided. A releasing lever 31 is rotatable for engagement with a hook pin 32 of the upper pressing lever 29, and the releasing lever 31 is urged by a spring 33 in a direction toward the engagement with the hook pin 32. Thus, the position of the upper pressing lever 29 is fixed, and the pressing springs upwardly pushes the lower pressing lever 30, and pushes through the bearing 34 on the lower pressing lever 30, the pressing member 24 to the heater 1. By urging in the direction indicated by an arrow b the pressure releasing button 35 slidably supported on an unshown cover, the engagement between the releasing lever 31 and the hook pin 32 of the upper pressing lever 29. Then, the upper pressing lever 29 and the lower pressing lever 30 move interrelatedly toward the bottom, so that the pressing member 24 is spaced apart from the heater 1.

Upon repressing, the pressing cam 36 rotates by an unshown driving means in a direction indicated by an arrow c to raise the projection 37 of the upper pressing lever 29, by which the releasing lever 31 urged by the spring 33 rotates so as to be engaged with the hook pin 32 of the upper pressing lever 29. Thus, the pressing state is restored. Thus, the manual release and the automatic re-pressing are carried out.

Figure 8:
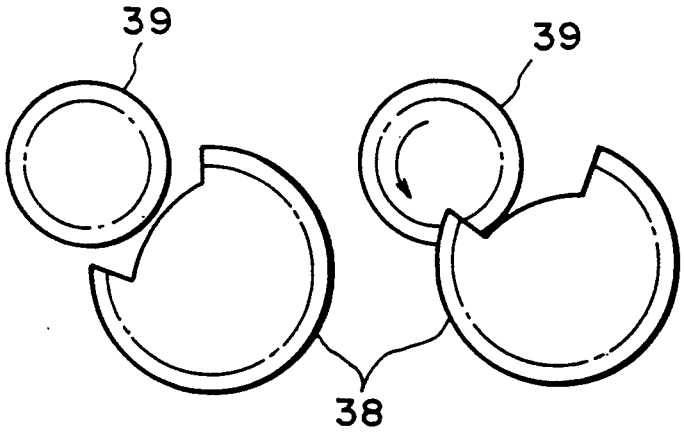
FIG. 8 is a side view of a repressing mechanism.

Referring to FIG. 8, the repressing means is such that a sector gear 34 and a pressing cam are mounted on a common shaft, and under the pressing state, the non-teeth portion of the gear shuts off the drive for the pressing cam to stop the pressing cam, and that upon pressure release, the non-teeth portion of the gear 38 is rotated by the pressing cam 36 so that the gear is meshed with a gear train 39 of the fixing apparatus. Upon the resumption of the apparatus, the gear 38 rotates to rotate the pressing cam 36 automatically to perform the repressing operation. Again, the pressing cam action stops corresponding to the non-teeth portion of the gear to establish the pressing state.

In this embodiment, the discharging portion is prevented to be opened, thus minimizing the exposure of the fixing film 5, and therefore, preventing the damage to the film or the like. The provision of the pressure releasing mechanism is effective to reduce the force required for pulling the jammed sheet during the jam clearance operation. Furthermore, the damage to the fixing film 5 can be avoided during the jam clearance operation. In this embodiment, the drive shut-off means such as a coupler arm or the like is not used between the fixing apparatus and the main assembly of the image forming apparatus. In the conventional heat roller type, the fixing rollers are rotatable during the jam clearance operation. This corresponds to rotation of the thin fixing film 5 in this embodiment. Then, there is a liability that the fixing film 5 is torn, depending on the direction of the jammed sheet. This is the reason why the drive shut-off means is not used. In addition, if there occurs such as thrust movement to be out of the image conveying region, or if the lateral shift control system is used, there is a liability that it becomes out of the controllable range. As for the measure against this, the drive shut-off means for disconnecting the driving system from the main assembly, is not used, so that when the pressure is released or when the jam clearance operation is performed, the fixing film 5 is not rotated.

In this embodiment, the measure against the dew from the vapor produced from the recording material, is taken. In this type of image fixing system, the apparatus becomes quickly operable because the low thermal capacity heater 1 is quickly heated to a predetermined temperature. Therefore, the recording material is fed while the temperatures of the pressing member 24 and the driving roller 6 are low. Particularly when the recording material is relatively wet, a large quantity of the water vapor is produced, and the vapor is condensed into dew on a portion having a low temperature. The dew can disturb the image.

In consideration of this, the apparatus of this embodiment is provided with wholes **26*a* in a separation guide 26 or the like, as shown in FIG. 1 to establish air passages for sucking the air from around the pressing member 24. Because of the provision of the passages, the vapor is not stagnated around the pressing member 24. In addition, the apparatus of this embodiment, equipped with positive air drawing means (fan) in the main assembly of the image forming apparatus to force the water vapor to the outside of the apparatus. Below the pressing member 24, there is provided a sheet 40 for collecting the dew droplets to collect and absorb the vapor therearound. It is also effective, when a large quantity of the water is produced, and the apparatus is inclined, to prevent the water from spilling. Thus, the sufficient measure is taken against the dew water. Similarly, the upper unit is provided with holes 28*a* in the sheet discharging cover to vent the air from around the fixing film 5. The same advantageous effects may be provided by discharging the air from around the fixing film 5** to the outside, by sucking using a fan, by blowing the air having a temperature increased by passing through the main assembly, or by circulating such air.

The description will be made as to the mounting of the image fixing apparatus onto the image forming apparatus.

Figure 9:
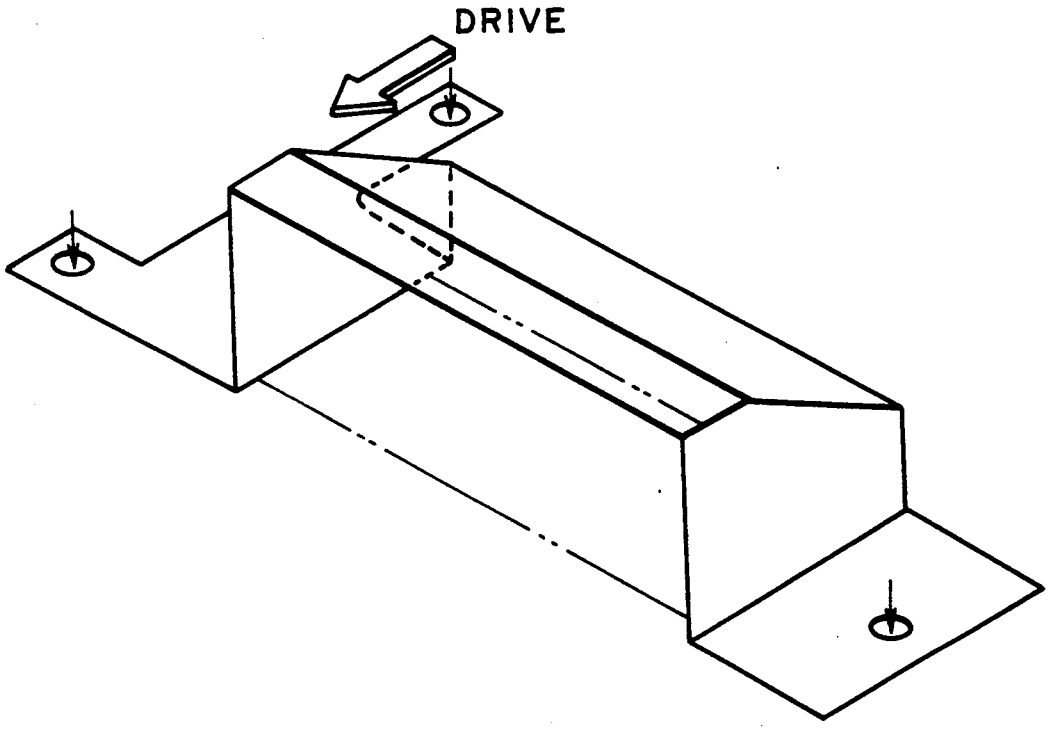
FIG. 9 is a perspective view illustrating mounting of the heating apparatus to a main assembly.

Referring to FIG. 9, the image fixing apparatus is securedly fixed at two points at the rear side (arrows at the left side in the drawing) where it receives the driving force from the main assembly and at one point at the front side (arrow at the right side). Thus, it is secured at three points. The three-point securing is effective to minimize the twist of the fixing apparatus, as will be advantageous in the system wherein the lateral shift control of the fixing film 5 is performed. More particularly, the three-point supporting system is advantageous in the accuracy of the supporting surface of the main assembly and in the resistance against twist, and therefore, even if the apparatus is installed on non-smooth floor, the influence to the fixing apparatus is minimized. Since the fixing apparatus is secured at two points at the driving side, the unavoidable twisting force applied in a predetermined direction from the main assembly to the image forming apparatus produces minimum twisting of the upper unit 18. For the same reason, it is desirable that the supporting points are right below the side plate or the like of the upper unit 18 adjacent the position where the image fixing apparatus receives the driving force and that the rigidity of the support is increased.

As regards the other one point of support, it is disposed adjacent the center of the gravity of the apparatus, since then the influence by the vibration or the like can be minimized with the advantage of minimizing the twisting of the upper unit 18. Since the supporting surface at the one point supporting side is desired to accommodate the influence, it is desirable that the supporting surface is made spherical, and fixed through an elastic member, or that the fixing apparatus is provided with a rotatable portion to be free from the twisting force from the supporting surface of the main assembly.

As regards the stability of the film conveyance, the measures against the crease, waving, folding-back of the fixing film 5, is desirable in addition to the lateral shift control described in the foregoing, because the fixing film 5 is thin and is hardly elastic.

Figure 10:
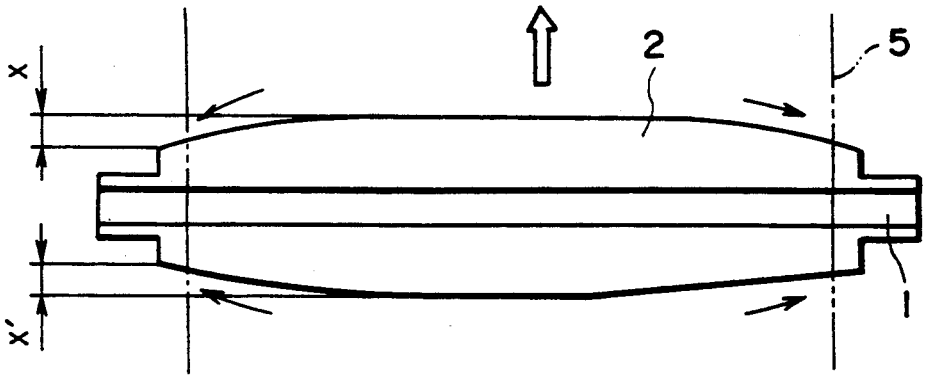
FIG. 10 is an enlarged view of a configuration of the supporting member of the fixing apparatus of FIG. 1.

As shown in FIG. 10, the measure against the crease and the waving which may result in the non-uniformity of the fixed image includes the crowning (0–0.2 mm) of the supporting member 2 at the fixing film inlet side and the discharge side so that the fixing film tends to be expanded longitudinally outside. In this case, if the crowning x and x' is too great, the slackness occurs at the opposite ends, since the elasticity of the fixing film 5 is small. For this reason, the crowning is preferably not more than 0.8 mm.

Figure 11:
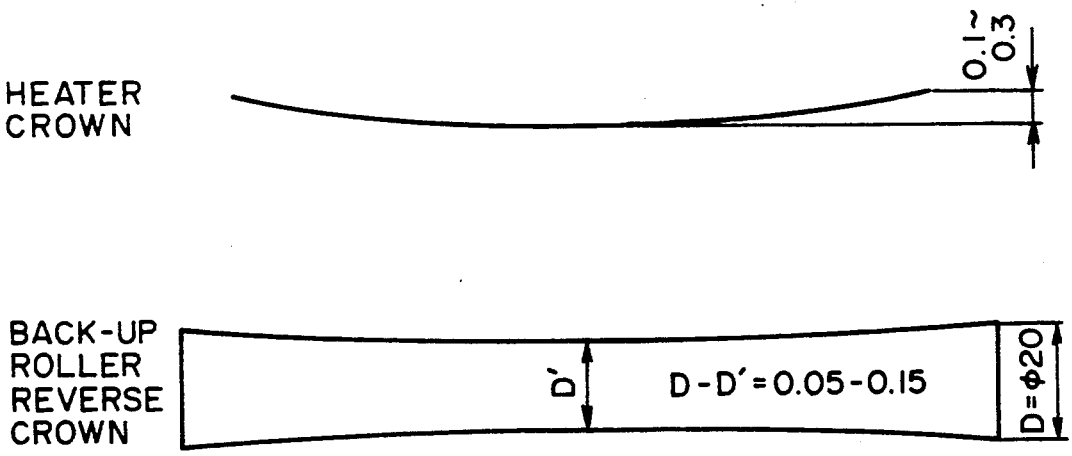
FIG. 11 is an enlarged view of the crowning of the heater and the pressing member.

As shown in FIG. 11, the heater mounting surface is also crowned (convex down) in a direction perpendicular to the conveyance direction of the fixing film. In this embodiment, the crowning is 0.1–0.3 mm provided by the supporting member By doing so, the folding-back of the fixing film at the lateral ends can be prevented. The crowning of the heater desirably includes the maximum crowning point at the longitudinal center. If the crowning is non-uniform, or if the convex or concave configuration is steep locally, the film is folded back.

The heater 1 is made of alumina base plate, and generally speaking, the alumina is difficult to machine with the result of sharp edge configuration.

Figure 12:
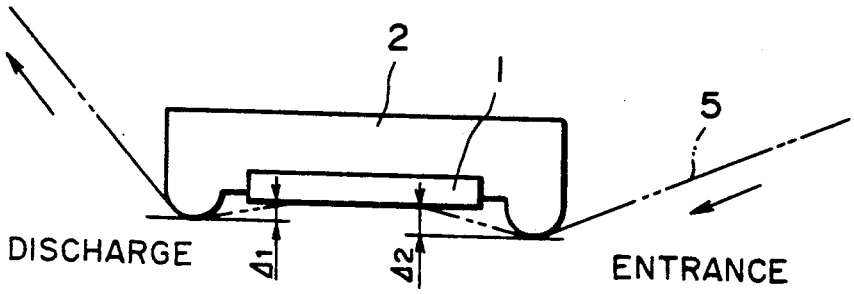
FIG. 12 illustrates the relation between the heights of the heater and the supporting member.

Referring to FIG. 12, in order to product the fixing film 5 from the edges, the supporting member 2 is projected at the opposite ends thereof beyond the heater 1, by which the sliding contact is prevented between the fixing film 5 and the end edges of the heater 1. In this case, the degree of the projection is selected to prevent the rolling of the pressing member on the supporting member 2.

The recording material conveying performance will be described. If the crowning of the heater 1 is too large, the forces toward the center of the recording material is produced with the result of frequent production of the crease in the recording material. In view of this, the present embodiment is such that, as shown in FIG. 11, the pressing part is reversely crowned, by which the recording material is urged toward the outsides. This is effective to prevent the production of the crease.

Figure 13:
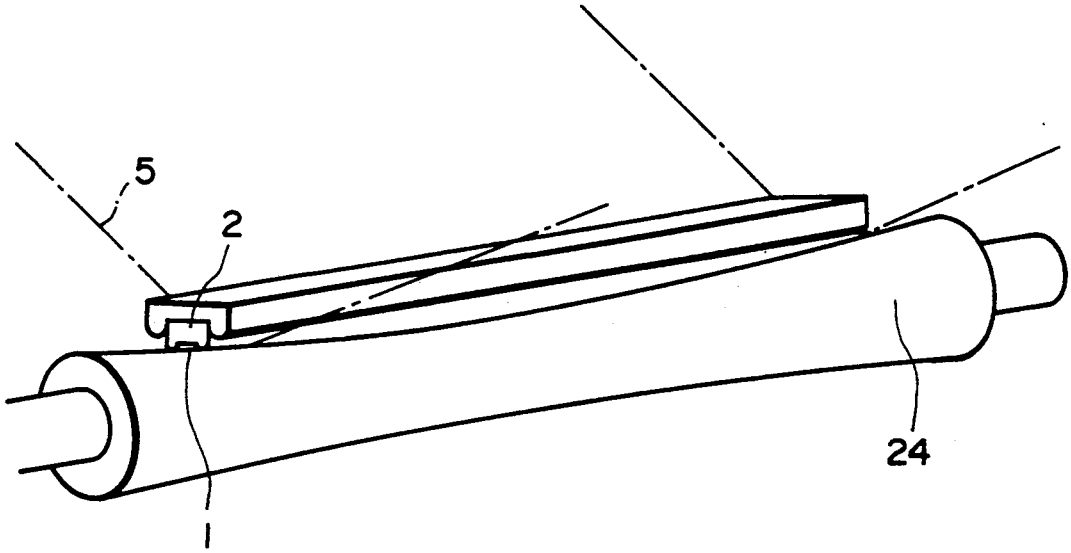
FIG. 13 is an enlarged perspective view illustrating the pressing between the heater and the pressing member.

FIG. 13 is a perspective view of the heater and the pressing member 24. If, however, the reverse-crowning of the pressing member 24 is too large, the urging or expanding tendency toward outsides becomes too strong, with the result that the trailing edge of the recording material is raised after the recording material is introduced into the fixing apparatus. If this occurs, the unfixed toner image is rubbed with a part of the main assembly with the result of disturbance of the toner image. In consideration of this, the surface of the heater is inclined relative to the pressing member 24 so that the surface of the heater is inclined at 8.5 degrees from a horizontal plane (nip angle $\gamma$ of FIG. 1) in an attempt to urge the recording material downwardly. However, the results have not been satisfactory.

Referring to FIG. 12, the supporting member 2 is convex down at the recording material inlet side than at the discharge side, that is, $\Delta 1 < \Delta 2$, by which the recording material entering angle is made larger than the nip angle to further urge the recording material downwardly. In addition, the crowning of the heater 1 is 0.1–0.3 mm, and the reverse crowning of the pressing member 24 is 0.05–0.15 mm. By doing so, the creasing of the recording material and the trailing edge rising thereof can be prevented.

In consideration of the worst case, the apparatus of this embodiment has a spur or spurs for confining the trailing edge portion of the recording material. The spur is normally urged by a spring to the recording material confining position. Upon the jam clearance operation, it is pivoted to be away in the jammed sheet retracting direction so as to prevent the damage to the recording material. After the jam clearance, the spur is returned to the regular position by the spring.

The amount or degree of the crowning of the heater, the reverse-crowning of the pressing member, the nip angle and the recording material entrance angle relative to the nip angle (convex degree of the supporting member) are suitably selected by one skilled in the art in consideration of the individual machines, conveying passage and the recording materials to be used. However, only by properly selecting them, a low cost and small size fixing apparatus can be realized without increasing the complicated structure and increasing the number of parts.

The conditions of the recording material separation will be described. In FIG. 1, a distance A is 6.5 mm from the center of the nip to the bent portion of the fixing film 5, and the radius of curvature B of the bent portion is 1.5 mm, and the angle $\theta$ of the deflection is 50 degrees. The distance from the center of the nip to the bent portion is selected in view of the width of the heater 1 in this embodiment (7 mm) with the heat generating resistance layer at its center. It is 6.5 mm in this embodiment. More particularly, the distance from the center of the heater to the end surface of the heater is 3.5 mm (7/2 mm), and the remaining distance is 3 mm in consideration of the molding and the strength of the supporting member 2. The dimensions would be properly selected in consideration of the width of the heater and the material of the supporting member. Similarly, the radius of curvature of the bent can be selected freely.

As regards the deflection angle of the bent portion, it is selected in consideration of the curl removal by the sheet discharging position, the size of the machine and the arrangement of the discharging passage. If, however, it is not more than 35 degrees, the improper separation tends to occur, and it imparts difficulty in disposing the discharging station above the nip. Therefore, the deflection angle is desirably larger than 35 degrees.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus, comprising:

a heater;

a film movable in contact with a recording material carrying an image, wherein the image on the recording material is heated by heat from said heater through said film;

an unheated driving rotatable member for driving said film, said driving rotatable member being positioned away from said heater;

wherein said driving rotatable member has a heat insulative surface layer.

2. An apparatus according to claim 1, wherein the surface layer is of rubber or resin material.

3. An apparatus according to claim 1, wherein said film is in the form of an endless belt.

4. An apparatus according to claim 1, wherein said film is slidable on said heater.

5. An apparatus according to claim 1, wherein said rotatable member is disposed downstream of said heater with respect to a movement direction of the recording material.

6. An apparatus according to claim 1, further comprising a pressing member cooperative with said film to form a nip therebetween, wherein said rotatable member is disposed downstream of the nip with respect to a movement direction of the recording material.

7. An apparatus according to claim 1, wherein said heating apparatus is effective to heat-fix the image on the recording material.

8. An apparatus according to claim 1, wherein said rotatable member is in the form of a roller, and wherein the surface layer is on a metal core.

9. An image heating apparatus, comprising:

a heater;

a film movable in contact with a recording material carrying an image, wherein the image on the recording material is heated by heat from said heater through said film;

an unheated driving rotatable member for driving said film, said driving rotatable member being positioned away from said heater;

wherein said rotatable member has a surface rubber layer having a thickness of 20 microns–1.5 mm.

10. An apparatus according to claim 9, wherein said surface layer is of silicone rubber material.

11. An apparatus according to claim 9, wherein the surface layer is electrically conductive.

12. An apparatus according to claim 9, wherein said film is in the form of an endless belt.

13. An apparatus according to claim 9, wherein said film is slidable on said heater.

14. An apparatus according to claim 9, wherein said heating apparatus is effective to heat-fix the image on the recording material.

15. An apparatus according to claim 9, wherein said rotatable member is in the form of a roller, and the surface layer is on a metal core.

16. An image heating apparatus, comprising:

a heater;

a film movable in contact with a recording material carrying an image, wherein the image on the recording material is heated by heat from said heater through said film;

a driving rotatable member for driving said film;

wherein a frictional coefficient between a surface of said rotatable member and said film is 0.3–3.

17. An apparatus according to claim 16, wherein the surface of said rotatable member is of rubber, and an inside surface of said film is of resin material.

18. An apparatus according to claim 16, wherein said film is in the form of an endless belt.

19. An apparatus according to claim 16, wherein said film is slidable on said heater.

20. An apparatus according to claim 16, wherein said heating apparatus is effective to heat-fix the image on the recording material.

21. An image heating apparatus, comprising:

a heater;

an endless belt movable in contact with a recording material carrying an image, wherein the image on the recording material is heated by heat from said heater through said belt;

a driving roller for -driving said belt;

a follower roller rotatably following an inside surface of said belt;

wherein a frictional coefficient between said driving roller and said belt is larger than a frictional coefficient between said follower roller and said belt.

22. An apparatus according to claim 21, wherein said driving roller has an outer diameter which is larger than an outer diameter of said follower roller.

23. An apparatus according to claim 1, wherein a winding angle of the belt relative to said driving roller is larger than that around said follower roller.

24. An apparatus according to claim 21, wherein said belt is in the form of a thin film.

25. An apparatus according to claim 21, wherein said driving roller has an elastic surface layer.

26. An apparatus according to claim 21, wherein said film is slidable on said heater.

27. An apparatus according to claim 21, wherein said heating apparatus is effective to heat-fix the image on the recording material.

* * * * *

UNITED STATES PATENT AND TRADEMARK OFFICE

CERTIFICATE OF CORRECTION

PATENT NO. : 5,091,752

DATED : February 25, 1992

INVENTOR(S) : Tamotsu OKADA

It is certified that error appears in the above-identified patent and that said Letters Patent is hereby corrected as shown below:

COLUMN 1

Line 15, "layer" should read --layer.--.

COLUMN 3

Line 14, "1 In" should read --1. In--.

COLUMN 4

Line 61, "direction" should read --direction.--.

COLUMN 9

Line 33, "member" should read --member.--.

COLUMN 12

Line 32, "-driving" should read --driving--.

Signed and Sealed this

Twenty-ninth Day of June, 1993

Michael K. Kirk

Attest:

MICHAEL K. KIRK

Attesting Officer

Acting Commissioner of Patents and Trademarks